United States Patent [19]

Janssen

[11] 4,186,241

[45] Jan. 29, 1980

[54] INSULATED WIRE AND METHOD FOR PRODUCING SAME

[75] Inventor: Harald Janssen, Reinbek, Fed. Rep. of Germany

[73] Assignee: Dr. Beck & Co. AG, Hamburg, Fed. Rep. of Germany

[21] Appl. No.: 965,919

[22] Filed: Dec. 4, 1978

[30] Foreign Application Priority Data

Dec. 3, 1977 [DE] Fed. Rep. of Germany ..... 2753917

[51] Int. Cl.[2] ..... H01B 3/00

[52] U.S. Cl. ..... 428/458; 156/51; 174/110 N; 427/117; 528/340

[58] Field of Search ..... 156/51, 52, 244.11; 174/110 SR, 110 N; 264/174; 428/458; 260/842, 850; 528/340; 427/117, 118, 120

[56] References Cited

U.S. PATENT DOCUMENTS

| | | | |
|---|---|---|---|
| 3,577,346 | 5/1971 | McKeown | 428/458 X |
| 4,058,640 | 11/1977 | Jung | 427/118 |
| 4,133,803 | 1/1979 | Klein | 528/340 |
| 4,145,474 | 3/1979 | Kertschen et al. | 427/117 X |

*Primary Examiner*—David A. Simmons
*Attorney, Agent, or Firm*—Michael J. Striker

[57] ABSTRACT

A partially crystalline thermoplastic polyamide for use in the preparation of insulated wires through the extrusion of a thermoplastic coating, consisting of terephthalic acid or a functional derivative thereof, hexamethylenediamine and isophoronediamine; also disclosed are a process for the preparation of insulated wires using the above polyamine; and an insulated wire employing such polyamide as the thermoplastic coating.

8 Claims, No Drawings

INSULATED WIRE AND METHOD FOR PRODUCING SAME

BACKGROUND OF THE INVENTION

Wires of the enamelled-core type have found extensive application in electronics in the construction of electrical equipment and transformers.

The conductor metal, generally copper or aluminum, is coated with a thin yet mechanically and thermally resistant synthetic resin film. The preparation of prior art wires involves multiple continuous applications of the resin enamel on the wire. The synthetic resin is applied in the form of a solution. Increasing the number of single applications and correspondingly reducing the thickness of each layer helps insure the production of smooth coatings free of blisters and solvent. In general, 6–10 single coats are applied. For a single (1 L) insulated copper wire of 1 mm diameter, an insulator thickness of 15–34 microns is contemplated by the German standard DIN 46435.

Evaporation of the solvent and hardening of the enamel is accomplished subsequent to the application of the resin solution through an annealing process. The evaporating solvent is removed from the annealing chamber by means of a ventilator. The annealing temperature is in the range of 300° to 550° C. and is dependent upon the enamel used, the diameter of the wire, the sizes of the chamber and the rate of the manufacturing process.

Enamel solutions now in use contain between about 20 and 40% resin; thus 60 to 80% of the solutions consists of solvent. Increasing the resin concentration leads to solutions of unsuitably high viscosity.

Isomeric mixtures of cresol and xylenol derived from lignite and anthracite coal are often used, in combination with other aromatic hydrocarbons, by virtue of their favorable solvent properties, commercial availability and high boiling ranges. In a special enamel solution, N-methylpyrrolidone and diethylformamide are also employed.

There are numerous drawbacks to the prior art method. The application of many thin coatings of enamel requires extensive technical resources and has a marked negative effect on the efficiency of the overall process. The removal of the solvent vapors required to achieve product of optimal quality can only be effected at great energy costs. The hardening of the resins concurrent with the separation of the solvents, and, in most cases, a crosslinking process with attendant splitting off of volatile by-products of the condensation, also requires good exhaust systems and correspondingly high energy inputs. As a result, with the present technology achievable production speeds are low: for example, about 25 m/min for 1 mm copper wires.

The dangers inherent in the use of the above-noted solvents, both in skin contact and in inhalation of the vapors, have been documented. In order to conform to authorized guidelines and to avoid damage to health safety precautions are necessary.

According to the state of the art techniques, the solvent vapors are eliminated from the annealing chamber by a ventilator. The installation of a combustion catalyser, through which a greater portion of the solvent vapors are eliminated, requires a considerable financial input and thus contributes to the expense of the end product.

To overcome the difficulties inherent in the use of the above solvents aqueous systems have been used. Resin varnish dispersions (for example, DT-OS No. 2351078) and aqeous solutions, (DT-OS No. 1720321 and DT-OS No. 2605790) however, have corresponding problems in the high energy requirements for the evaporation of great quantities of water, the complete elimination of which is necessary for the preparation of a functional insulated wire. In addition, these aqueous systems require the use of additional organic components, such as high-boiling co-solvents, dispersion and thickening components and amines to increase the water solubility of the resins. These components have their own environmental disadvantages. The insulation of wires through the use of melts of synthetic resins, particularly hardenable polyester imides, has also been proposed (DT-OS No. 2135157 and DT-OS No. 2401027). The use of these proposed melts of highly reactive resins is problematic at the temperature disclosed on account of their storage instability. Through the use of this process the achievable production speeds are in no case higher, and in some cases considerably lower, than those achieved with the previously discussed conventional procedures.

There is disclosed in the copending U.S. application Ser. No. 811,364 a process for the preparation of insulated wires through the extrusion of thermoplastic coatings, in which partially crystalline thermoplastic polycondensates with melting points above 170° C., and preferably above 250° C., are employed.

This process achieves decided improvements in overcoming some of the disadvantages of the prior art process:

(1) As this process utilizes no aromatic hydrocarbon solvent or other similar toxic substance, the process is substantially more desirable environmentally. Further, the need for combustion apparatus for eliminating the solvent and the need for the elaborate safety devices noted above, is obviated. In addition, the energy savings achieved through elimination of the evaporation process improves the efficiency of the process.

(2) The process achieves the preparation of both single (1 L) and double (2 L) insulated wires, the later having a contemplated coating thickness of 30–47 microns, in a single application. This constitutes an improvement over the prior art requirements of 6–10 applications.

(3) No hardening process is required for the thermoplastic coating, resulting in a further conservation of energy.

(4) As a consequence of the above, the production speed and thus the industrial applicability of the process is clearly and markedly improved. Thus, in the preparation of 1 mm copper wires, speeds of 500 m/min become practicable; thus, an improvement by a factor of 20 over the prior art processes is achieved.

The process of extrusion of thermoplastic coatings disclosed before the previous invention has found use in the cable industry for the preparation of thick-walled bundle coverings as well as in the preparation of insulated wires.

In the examples of the above-noted application, the conditions for preparing extrusion coatings consisting of polyethyleneterephthalate, 6,6-polyamide and polyphenylene sulfide were described. In the specifications, the principal applications of araliphatic polyamides prepared from aromatic dicarboxylic acids and their functional derivatives such as esters or acid chlorides, and non-branched aliphatic diprimary diamines, as well as specified aliphatic dicarboxylic acids and aromatic diamines, were disclosed. For example, the following polycondensates were considered: terephthalic acid and hexamethylenediamine, terephthalic acid and ethylenediamine, terephthalic acid and nonamethylenediamine, terephthalic acid and decamethylenediamine, and adipic acid and p-phenylenediamine.

The prior art polyamides exhibit the desired high melting points for the present purpose, but the gap between the melting point and the decomposition point is too narrow. In most cases, some decomposition of the polymers occurs simultaneously with the melting; that is, the noted polymers do not melt without some decomposition. It follows that in these cases, preparation by mechanical working of the polymers is not possible because the physical properties of the polymers are too restrictive upon the preparative conditions.

In the above-noted process it was disclosed that in the case of high-melting thermoplastics, co-condensation with monomers of different structure causes a reduction of the melting point through a disintegration of the crystal matrix. As examples, with high melting polyamides or with those which do not melt without decomposition, a portion of the unbranched aliphatic diprimary diamines can be replaced with linear aliphatic diamines with side groups, e.g., part of the hexamethylenediamine can be replaced with trimethylhexamethylenediamine, or a portion of the aromatic dicarboxylic acids can be replaced with aliphatic dicarboxylic acids.

DESCRIPTION OF THE INVENTION

The present invention resides in the recognition that the use of special co-condensates according to the previously noted conditions is particularly advantageous, a fact which is not obvious from the prior art. In particular, it was in no way predictable that compositions of partially crystalline polyamide of terephthalic acid or its functional derivatives, such as esters or acid chlorides, hexamethylenediamine and isophoronediamine with an isophoronediamine content of at least 5 Mol % based on total amine content would lead to especially advantageous results.

The above-noted polyamide compositions have melting points of at least 280° C. and viscosity numbers of at least 0.5. The viscosity number, or reduced specific viscosity, is defined according to the following formula:

$$\eta \text{ red} = \frac{\eta - \eta_o}{\eta_o \cdot C}$$

where $\eta$=efflux time of the polymer solution in seconds $\eta_o$=efflux rate of the solvent in sec.

C=concentration of the polymer solution in g/100 ml. The synthesis of the prior art polyamides, not forming a part of this invention, follows the known procedures of preparative polyamide technology.

The terephthalic acid and diamines are used in molar ratios of 1:1 to 1:1.1. To produce high molecular weight products ratios close to 1:1 are preferable. In the preparation of the inventive thermoplastic, equimolar amounts of the terephthalic acid and total diamine are generally employed.

In principle, equimolar amounts of hexamethylenediamine and isophoronediamine could be used. The melting point drops with increasing isophoronediamine content; the pure terephthalic acid-isophoronediamine polyamide melts at 270°-280° C. For wires for which a high softening temperature is desired, a reduction of the isophoronediamine content to the lowest possible value which still insures a satisfactory gap between melting and decomposition temperatures is mandated. Thus, for example, the composition of the Example, with a 12 Mol % isophoronediamine content based on total diamine, exhibits a melting point of 340°-350° C. and the wires coated therewith show a softening temperature or cut-through temperature of about 265°-275° C. This composition is quite suitable for use in the extrusion process, as decomposition is first noticeable around 385° C. Wire prepared with this material corresponds to that having a temperature index of 155 (type W 155, German standard).

If one increases the isophoronediamine content to 20 Mol %, the melting point drops to 310°-320° C. This composition can also find application, but the temperature index is correspondingly reduced.

The limiting amount of isophoronediamine content cannot be precisely determined. In cases where Type W 155 insulated wires are desired, the isophoronediamine content should not be raised above 15 Mol %.

A composition with 8 Mol % isophoronediamine content exhibits a melting point of 365°-370° C. At around 380° C. noticeable decomposition begins; however, the material is at that point just workable. With further reductions in the isophoronediamine content the gap between the melting and decomposition points becomes increasingly smaller and the difficulties more pronounced.

In order to keep the degree of decomposition during the preparative process as low as possible, the composition is kept in the extruder for only a short time. Polyamides with isophoronediamine contents less than 5 Mol % are not practical for use in present technology.

It should also be mentioned that for the new insulated wires produced by the extrusion process no new testing procedures are required. The tests follow those of the prior art for enamel insulated wires, according to DIN 46453. Furthermore, the wires prepared according to the above method are suitable for the same uses as the previously utilized enamel insulated wires.

EXAMPLE

A fine-granular polyamide composed of terephthalic acid, hexamethylenediamine, and isophoronediamine, with a ratio of hexamethylenediamine to isophoronediamine of 88:12 and a ratio of terephthalic acid to total amine of 1:1, exhibiting a reduced viscosity of 0.8 and a melting range of 340°-350° C. is fed into a prior art extruder.

An annealed copper wire of 0.6 mm diameter is preheated, and passed through the coating zone of the extruder, after which it is treated by a stripper which regulates the thickness of the coating.

After cooling the wire is wound onto spools. The production speed reaches 210 m/min. The coating produced is of a 60 micron thickness, and conforms to grade 2 of DIN 46435 of April 1977. Properties of the wire: Unless otherwise noted, all values are according to DIN 46435, Part 1, of April 1977.

| Hardness | 2H-3H |
|---|---|

Residual hardness after exposure to the following substances (in each case, for 30 minutes at 60° C.)

| | |
|---|---|
| Ethanol | H |
| Benzene | 2H-3H |
| Water | H - 2H |
| Softening temperature | 265-275 |
| Resistance to rupture | acceptable |
| Flexibility | acceptable over a linear extension of 15% and winding around its own diameter |
| Heat shock resistance (after winding around its own diameter) | acceptable at 220° C. |
| Tinnability (at 375° C. according to DIN 1707 - L - Sn 60 P6) | 1.5 seconds. |

It will be understood that each of the features described above, or two or more together, may also find a useful application in other types of insulated wire and method for producing same differing from the types described above.

While the invention has been illustrated and described as embodied in a novel insulated wire and method for producing same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A partially crystalline thermoplastic polyamide for use in the preparation of insulated wires through the extrusion of a thermoplastic coating, said polyamide comprising an acid component and an amine component in a ratio of 1:1 to 1:1.1, wherein said acid component is terephthalic acid or a functional derivative thereof, and said amine component consists of hexamethylenediamine and isophoronediamine, said isophoronediamine comprising at least 5 Mol % of the total amine component.

2. The polyamide of claim 1, wherein the ratio of said acid component to said amine component is about 1:1.

3. The polyamide of claim 1, wherein said isophoronediamine comprises between 5 and 20 Mol % of the total amine component.

4. The polyamide of claim 1, wherein said isophoronediamine comprises between 8 and 15 Mol % of the total amine component.

5. The polyamide of claim 1, wherein said isophoronediamine comprises about 12 Mol % of the total amine component.

6. A process for the preparation of insulated wires through the extrusion of a thermoplastic coating, involving the use of a partially crystalline thermoplastic polyamide, said polyamide comprising an acid component and an amine component in a ratio of 1:1 to 1:1.1, wherein said acid component is terephthalic acid or a functional derivative thereof, and said amine component consists of hexamethylenediamine and isophoronediamine, said isophoronediamine comprising at least 5 Mol % of the total amine component, said process comprising passing a conductor wire through a coating zone of an extruder to coat said wire; and treating said wire to regulate the thickness of the applied coating.

7. The process of claim 6, wherein said conductor wire is preheated before passage through said coating zone of said extruder.

8. An insulated wire having an extruded thermoplastic coating of a partially crystalline thermoplastic polyamide, said polyamide comprising an acid component and an amine component in a ratio of 1:1 to 1:1.1, wherein said acid component is terephthalic acid or a functional derivative thereof, and said amine component consists of hexamethylenediamine and isophoronediamine, said isophoronediamine comprising at least 5 Mol % of the total amine component.

* * * * *